US008013737B2

(12) United States Patent
Tiwari et al.

(10) Patent No.: US 8,013,737 B2
(45) Date of Patent: Sep. 6, 2011

(54) VOICE RECORDER BASED POSITION REGISTRATION

(75) Inventors: Ankit Tiwari, Farmington, CT (US); Jae-Hyuk Oh, Glastonbury, CT (US); Christian M. Netter, West Hartford, CT (US); Luiz Fer Bacellar, Glastonbury, CT (US); Thomas M. Gillis, Bloomfield, CT (US)

(73) Assignee: UTC Fire and Security Corporation, Farmington, CT (US)

( * ) Notice: Subject to any disclaimer, the term of this patent is extended or adjusted under 35 U.S.C. 154(b) by 403 days.

(21) Appl. No.: 12/231,473

(22) Filed: Sep. 3, 2008

(65) Prior Publication Data

US 2010/0052903 A1 Mar. 4, 2010

(51) Int. Cl.
*G08B 1/08* (2006.01)

(52) U.S. Cl. ..... 340/539.22; 340/539.26; 340/517; 340/3.5

(58) Field of Classification Search ..... None
See application file for complete search history.

(56) References Cited

U.S. PATENT DOCUMENTS 4,821,027 A * 4/1989 Mallory et al. ..... 340/521
5,686,885 A 11/1997 Bergman
6,624,750 B1 9/2003 Marman et al.
6,686,838 B1 2/2004 Rezvani et al.
6,943,681 B2 9/2005 Rezvani et al.
6,965,313 B1 11/2005 Saylor et al.
6,980,106 B2 * 12/2005 Sutphin ..... 340/539.26
7,035,804 B2 * 4/2006 Saindon et al. ..... 704/271
7,042,349 B2 5/2006 Bergman et al.
7,113,090 B1 9/2006 Saylor et al.
7,366,498 B2 4/2008 Ko et al.
7,411,921 B2 8/2008 Strong et al.
2006/0154642 A1 * 7/2006 Scannell ..... 455/404.1
2007/0130599 A1 * 6/2007 Monroe ..... 725/105
2009/0125918 A1 * 5/2009 Kansal et al. ..... 719/328

* cited by examiner

*Primary Examiner* — Jennifer Mehmood
*Assistant Examiner* — Brian Wilson
(74) *Attorney, Agent, or Firm* — Kinney & Lange, P.A.

(57) ABSTRACT

A system and method for monitoring a location having at least one sensor for sensing a change in at least one condition using voice tags to announce alarms. The system includes a registration process where a voice recorder and a digital conversion unit form digital voice tags from recorded speech representing the type and location of sensors. The voice tag is sent as part of an alarm message or pre-stored in a control panel for later retrieval such that the type and location of an alarm is reproduced vocally at the time of the alarm. The registration process may be completed with a registration module which may be a keypad or the voice recorder may be included in the sensors. Additional features include sensor location change notification to ensure the stored voice tag represents the current location of the sensor.

3 Claims, 5 Drawing Sheets

VOICE RECORDER BASED POSITION REGISTRATION

BACKGROUND

The present invention relates to security and fire systems in locations such as buildings. More particularly, the invention relates to a system and method for registering the specific location of at least one sensor for sensing a change in at least one condition.

Security and fire systems are spatially distributed by their very nature. In order for a first responder to locate the sensor when it sends an alarm, it is necessary to register the physical location of all the distributed modules when installing the system. Prior art location registration techniques have been totally manual, where the installer needs to record the physical location of each sensor in the system, either before or after the installation of the module. One prior art system allows the user to walk through a set of pre-recorded voice prompts at the panel to register the sensor. Other systems require manual data entry using small, inconvenient keypads, which is tedious, cost-inefficient, and, most importantly, vulnerable to human errors.

SUMMARY

A sensor registration process and system is provided for use with fire and security systems where sensors are installed by an installer. The sensor is used to sense a change in at least one condition. In order to be effective, a first responder must be able to quickly determine the location where a sensor raising an alarm is installed. The registration process includes a voice recorder for recording words spoken at the time of installation giving the location of the sensor. Sensor registration includes noting the type of sensor and its location and storing this information to be later recalled and used to identify the specific location of the sensor on the premises. The voice recording is converted to a voice tag via a coder/decoder to send to the control panel using a digital message for storing or to indicate a current alarm if the voice tag is stored in the sensor. When the voice tag is stored in the control panel, the sensor also provides a unique identification number (ID) during the registration process that is stored and associated with the voice tag. The ID is included in the alarm signal and used to retrieve the voice tag associated with the sensor now raising an alarm.

DETAILED DESCRIPTION

The present invention provides a system and method for registering a sensor used to monitor a space or location. The sensors may be, by way of example and not of limitation, selected from one or more sensors capable of monitoring motion, smoke, heat, carbon monoxide, water, water vapor, door integrity, window integrity, lock integrity, audio changes, video changes and other activities at a location.

Figure 1:
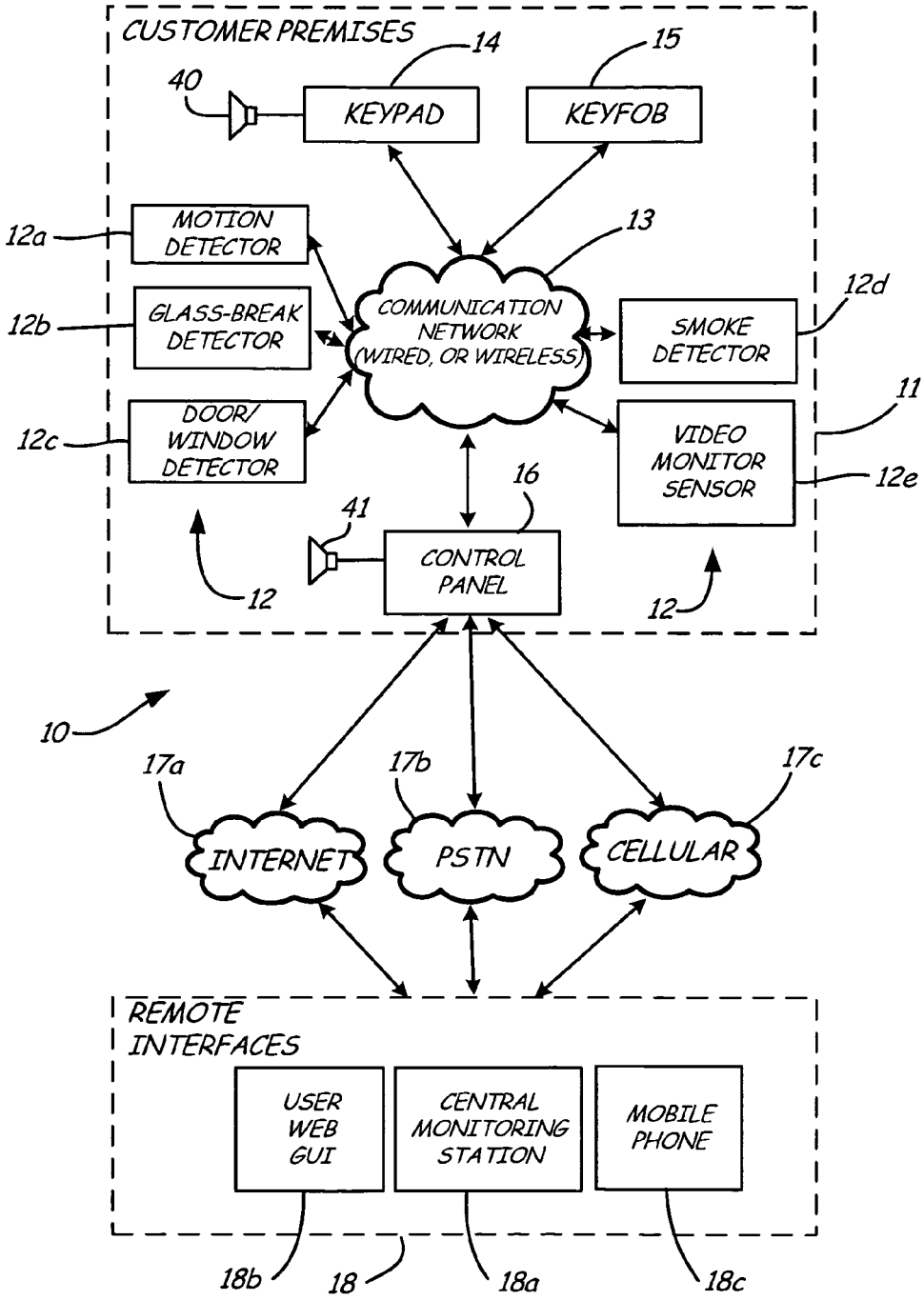
FIG. 1 is a block diagram illustrating a fire and security system.

FIG. 1 illustrates fire and security system 10, which is located on premises 11 and which includes a plurality of sensors 12 such as motion detector 12*a*, glass-break detector 12*b*, door or window contact sensor 12*c*, smoke detector 12*d*, and video monitor 12*e*. A communication network 13, which is wired or wireless, connects the sensors to control panel 16. Keypad 14 and key fob 15 are examples of devices which allow the user to activate or deactivate the fire and security system. Additionally, keypad 14 contains an encoder/decoder element and transceiver element used to receive digital transmissions of voice tags from control panel 16 and a speaker element to provide spoken identification of the status of the sensors in the system. Keypad 14 can be wireless or hardwired. In some embodiments, keypad 14 is also used as a registration module and carried from one sensor to another during the registration process. Control panel 16 located on premises 11 sends digital signals via internet 17*a*, land line 17*b* or cellular network 17*c*, to a remote location 18 for reception by central monitoring station 18*a*, user web interface 18*b*, or mobile phone 18*c*.

During the use of system 10, when a change occurs in a condition being monitored, sensor 12 associated with that condition sends an alarm signal to control panel 16 which then provides the voice tag associated with the sensor raising the alarm to devices such as keypad 14 on the premises and to remote central monitoring station 18*a*. It is then relayed to assist first responders such as firefighters and security personnel to locate the sensor and address the change in condition. The voice tag generally includes a pre-recorded portion related to the specific type of sensor 12 and a second portion related to the location recorded during the registration process associated with that sensor. This verbal announcement is made over speakers 40 and 41.

The first task the installer must complete is to prepare system 10 for installation and registration of sensors 12. This process starts by powering up control panel 16. Next, registration module R, which may be keypad 14 in some embodiments, is powered up. Registration module R prompts the user to enter a valid authentication code. Once a valid code is entered, the system is in registration mode. If registration module R is to be permanently installed in the system such as keypad 14, it then prompts the user to record a voice tag describing the keypad's name and location. Registration module R/keypad 14 then transmits its unique identification code, voice tag, and device type information to the control panel to be stored. In some embodiments, control panel 16 includes a speech-to-text element and additionally converts the voice tag to text and stores that as well. With the authentication completed and the keypad 14 registered, sensors 12 can now be registered.

Figure 2:
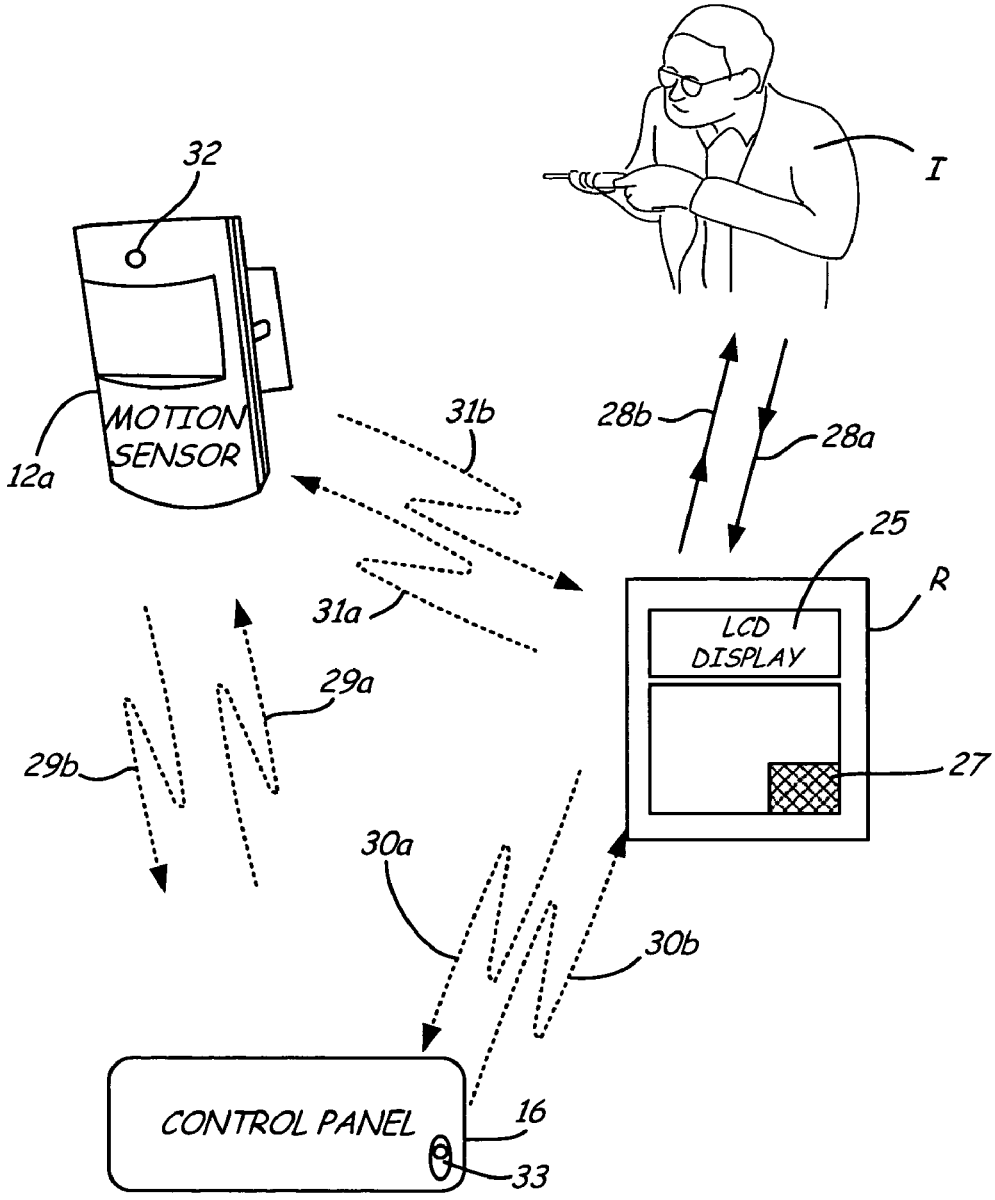
FIG. 2 is a schematic view illustrating the registration of sensors in the system of FIG. 1.

FIG. 2 illustrates the installation and registration process for sensors 12. A procedure for positioning and mounting each sensor 12*a*-12*e* is used to insure proper connectivity to control panel 16. First, the coarse location for mounting based upon the sensing requirements selected, ex. the corner of a large room for motion sensor 12*a*. Using a signal strength indicator on registration module R, such as display 25 of keypad 14, installer I observes the connectivity strength of the network connection to control panel 16 around the selected location. If insufficient or no connectivity is found at the selected mounting location, a repeater, not shown, is installed between the location and control panel 16. Once the connectivity of the location is confirmed, installer I powers up the sensor to be installed at that location.

After installer I selects the mounting location for motion sensor 12*a* and it is powered up, it sends its unique identification code or ID (that is pre-stored in the sensor or added during mounting) to the registration module via link 31*b*. Registration module R alerts installer I to the presence of the new device, ex. a "New Device Found" indication on display 25, and provides a prompt for a group number and a voice tag that describes the sensor's location. The group number is used to identify whether sensor 12 is a 24 hour sensor, restoral sensor, etc. The voice tag is generally a phrase such as "dining room window", "west entry door", etc and is created by recording the installer's voice spoken into voice recorder 27. An internal or external microphone may be used by voice recorder 27 to make the recording. Registration module R then converts the voice recording using a digital converter to a digital voice tag and sends it, the associated identification code, and the group number to control panel 16 via link 30 to be saved in storage 33. In some embodiments, control panel 16 or registration module R includes a speech-to-text converter element and additionally converts the voice tag to text and stores that as well.

Registration module R then prompts the installer to mount sensor 12*a* at its desired location and test the connectivity between mounted sensor 12*a* and the control panel 16. After mounting sensor 12*a*, installer I uses registration module R to send a test command over link 31*a* to sensor 12*a* so that sensor 12*a* will test its connection to control panel 16. Upon receipt of the test command, sensor 12*a* then sends a test signal over link 29*b* to control panel 16. In response to successful signal reception, control panel 16 sends a success signal back to sensor 12*a* over link 29*a*. Sensor 12*a*, upon receipt of the success signal from control panel 16, turns on indicator 32 for communicating the success to installer I. Installer I then repeats the registration process for all remaining sensors 12 (ex. sensors 12*b*-12*e* shown in FIG. 1).

Figure 3:
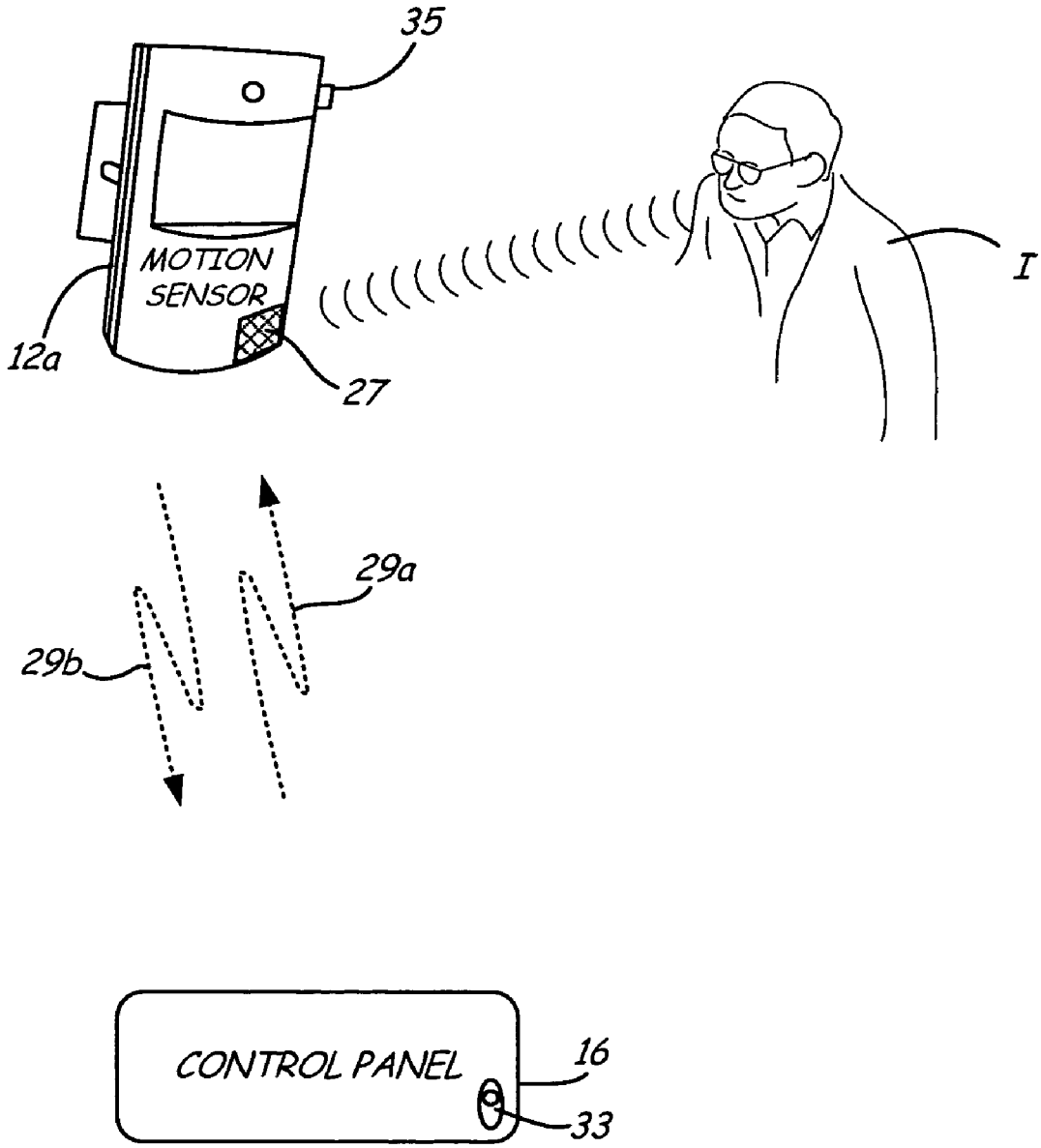
FIG. 3 is a schematic view of a different embodiment not requiring a specific registration module.

FIG. 3 shows another embodiment that does not require the use of a designated registration module. Each sensor 12 is equipped with voice recorder 27, a digital conversion unit for converting a recorded voice to a voice tag and activation button 35. In the example illustrated, installer I presses activation button 35 on a sensor (ex. sensor 12*a* shown on FIG. 3) and then speaks the location where sensor 12*a* is being installed into the sensor's voice recorder 27. The sensor then converts the voice recording to a voice tag and transmits it and its unique identification number using a digital signal to control panel 16 to be saved in storage 33. Sensor 12*a* is now registered and installer I repeats this process with all other sensors 12*b*-12*e*. This process can additionally be repeated during operation with mobile devices such as keyfob 15. For example, the user may create a new voice tag such as "I need help and I'm in the dining room." This distress call can then be routed to the first responders so that they may provide help quickly.

Figure 4:
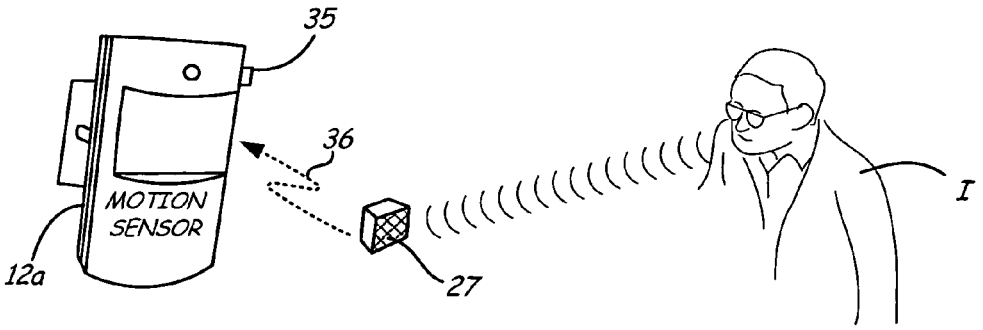
FIG. 4 is a schematic view of an embodiment where the voice recorder is separate from the sensor.

FIG. 4 shows an alternate embodiment where voice recorder 27 may provide the digital voice recording over wired or wireless link 36 to sensor 12*a*. This embodiment is useful for sensors not equipped with their own voice recorders.

Figure 5:
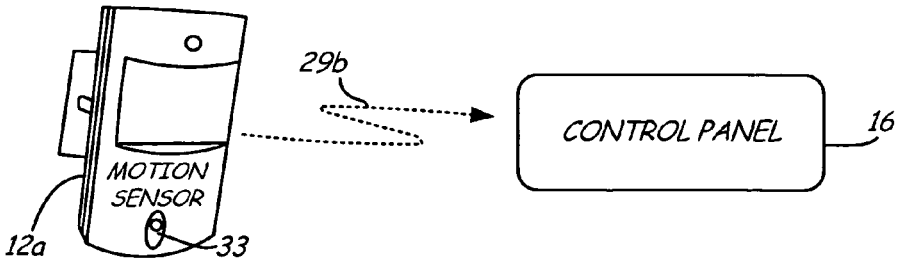
FIG. 5 is a schematic view of an embodiment where the voice tag is stored in the sensor.

A further embodiment shown in FIG. 5 allows the storage of the voice tag to be located in sensor 12*a*-12*e* itself rather than in control panel 16. In this example, sensor 12 transmits the voice tag stored in its memory to control panel 16 at the time of alarm as part of the alarm signal.

Once sensors 12 are installed and registered using the voice tag based registration of the various embodiments, system 10 is ready to operate. When an alarm signal is received from a sensor, such as when smoke is detected, a voice recording is concatenated based on the type of alarm signal. An example is: <PreRecorded_Device_Type_Message> plus <User_Recorded_Voice_Tag>. The prerecorded device type message may be "Motion Detected at" for motion detectors, "Door/Window Open at" or "Door/Window Closed at" for door/window detectors when doors or windows are opened or closed, "Carbon Monoxide Detected at" for carbon monoxide detectors. Control panel 16 plays the concatenated voice recording via speaker 41 or transmits it to keypad 14 to play via speaker 40 to announce the alarm locally. In some embodiments, control panel 16 is additionally capable of leaving a voice message reporting the system alarm to mobile phone 18*c* or other telephone designated to receive the notice. In embodiments that include video monitoring sensor 12*e*, control panel 16 can combine the reproduced voice tag and the event related pre-alarm video recording into an audio-video file and send it as an email attachment over the internet or to a mobile phone. Additionally, control panel 16 uses the location text (obtained by speech-to-text conversion) to send an alarm message to a remote interface such as at least one from the following list: a central monitoring station 18*a*, user web GUI 18*b*, as an email attachment, to mobile phone 18*c*, etc. It should be noted that the prerecorded device type message may also be customized by a user in his/her own voice.

System 10 may also include a sensor location change notification. This allows the sensor to notify a user (example: a message on display 25) when the mounting location of an installed and registered sensor is changed. When such a change is detected, the system notifies and prompts the user to change the location related voice-tag so that it corresponds to the new location.

Figure 6:
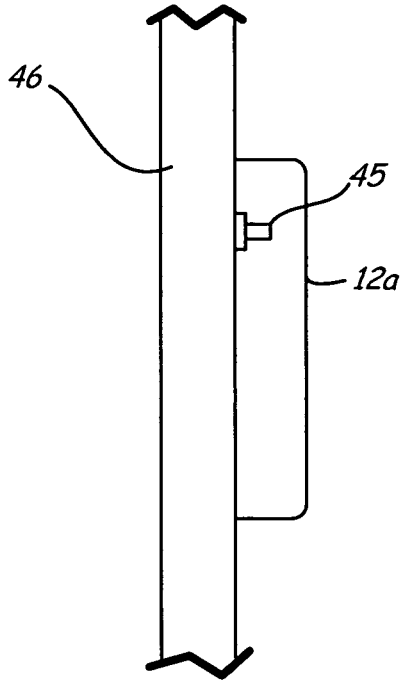
FIGS. 6 and 7 are side elevation views of an apparatus for use in sensor location change detection.
Figure 7:
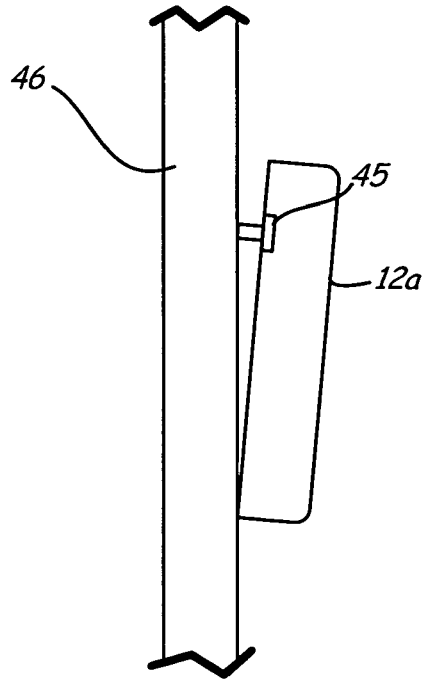

FIGS. 6 and 7 show one procedure to detect a change in mounting location. Sensor 12*a* has wall-tamper switch 45 in place in FIG. 6 so that when it is dismounted from wall 46, in FIG. 7, the wall-tamper switch is tripped when it breaks contact with the wall. The sensor is then reregistered following the processes outlined above.

Voice generated status messages make system 10 easier to use and understand. The system makes it intuitive for both the user and the first responder to locate the alarm and significantly increases the speed and accuracy of the installation. The user no longer has to go between the selected location and the panel repeatedly or use a small inconvenient keypad in a tedious and error prone process to register the sensor.

Although the present invention has been described with reference to preferred embodiments, workers skilled in the art will recognize that changes may be made in form and detail without departing from the spirit and scope of the invention.

The invention claimed is:

1. A method for installing a sensor for sensing a change in at least one condition at a location; comprising the sequential steps of:

powering up a control panel;

powering up a registration module having a signal strength indicator and a voice recorder;

first testing network signal strength at the location selected by using the signal strength indicator on the module to find a location having the desired signal strength;

powering up a sensor, the sensor having its own identification code;

receiving the identification code from the sensor, and indicating on a display of the module the presence of the sensor;

speaking a voice tag identifying the sensor into the voice recorder on the module; the module converts the voice recording of the voice tag to a digital voice tag that the module then forwards to the control panel for storage by the control panel;

mounting the sensor in a selected location having confirmed signal strength; and sending a test command from the module to the sensor so that the sensor sends a test signal to the control panel that responds with a success signal to the sensor.

2. The method of claim 1, wherein the condition is selected from the group consisting of motion, smoke, heat, carbon monoxide, water, water vapor, door integrity, window integrity, audio changes, video changes and lock integrity.

3. A monitoring system prepared according to the method of claim 1.

* * * * *